US007455809B2

(12) United States Patent
Grayson et al.

(10) Patent No.: US 7,455,809 B2
(45) Date of Patent: Nov. 25, 2008

(54) MATERIAL SUBMERGENCE SYSTEM

(75) Inventors: James Grayson, Gurdon, AR (US); Chris T. Vild, Cleveland Hts., OH (US)

(73) Assignee: Pyrotek, Inc., Spokane, WA (US)

( * ) Notice: Subject to any disclaimer, the term of this patent is extended or adjusted under 35 U.S.C. 154(b) by 226 days.

(21) Appl. No.: 10/881,738

(22) Filed: Jun. 30, 2004

(65) Prior Publication Data

US 2005/0017417 A1 Jan. 27, 2005

Related U.S. Application Data

(60) Provisional application No. 60/483,732, filed on Jun. 30, 2003.

(51) Int. Cl.
*C22B 21/00* (2006.01)

(52) U.S. Cl. ..... 266/217; 266/44; 75/680

(58) Field of Classification Search ..... 266/44, 266/217, 235, 234; 75/680
See application file for complete search history.

(56) References Cited

U.S. PATENT DOCUMENTS

| | | | | |
|---|---|---|---|---|
| 1,944,733 | A * | 1/1934 | Schoeffel et al. | 266/44 |
| 4,169,584 | A | 10/1979 | Mangalick | |
| 5,650,120 | A * | 7/1997 | Morando | 266/233 |
| 5,662,725 | A | 9/1997 | Cooper | |
| 5,993,728 | A * | 11/1999 | Vild | 266/217 |
| 6,217,823 | B1 * | 4/2001 | Vild et al. | 266/44 |

* cited by examiner

*Primary Examiner*—Scott Kastler
(74) *Attorney, Agent, or Firm*—Fay Sharpe LLP

(57) ABSTRACT

A gas injection tube includes a first end adapted to connect to a reactive gas source and a second end. A tube base attaches to the second end of the gas injection tube. The gas injection tube includes a passageway and the tube base includes a channel. The passageway communicates with the channel to provide gas to a molten metal stream traveling through the channel.

4 Claims, 3 Drawing Sheets

MATERIAL SUBMERGENCE SYSTEM

The present invention claims priority from U.S. provisional application Ser. No. 60/483,732 filed Jun. 30, 2003.

BACKGROUND OF THE INVENTION

In the purification of molten metals, particularly aluminum, it is frequently desired to remove dissolved gases such as hydrogen or dissolved metals, chiefly magnesium. The removal of dissolved gas is known as "degassing", while the removal of magnesium is known as "demagging".

When demagging or degassing aluminum, chlorine or nitrogen gas, respectively, is released into a quantity of molten aluminum, this quantity generally being referred to as a bath of molten aluminum. The bath is usually contained within the walls of a reverbatory furnace. When demagging aluminum, chlorine gas is released into the bath and the chlorine bonds, or reacts, with the magnesium wherein each pound of magnesium reacts with approximately 2.95 pounds of chlorine to form magnesium chloride, a generally insoluble material which can be skimmed from the surface of the bath. Several methods for introducing chlorine into a molten aluminum bath are known.

A gas injection tube has been used to introduce gas into a molten metal stream where molten metal is pumped from one chamber to another. The gas injection tube is inserted into a hole in the pump base of the molten metal pump either upstream of, downstream of or in the pump chamber. Gas, such as chlorine, is injected into the molten metal stream where it can react with the molten metal.

The pump base of the molten metal pump is one of the more expensive pieces of the pump assembly. Since the gas injection tube is inserted into a hole in the base, it is difficult to retrofit a metal pump that does not include a gas inlet. Also, the more holes that are drilled into the base, the greater the likelihood that the base can wear out more quickly. Accordingly, it is desirable to provide a gas injection tube having a tube base that can be positioned near the outlet of the pump base of the molten metal pump.

SUMMARY OF THE INVENTION

According to a first aspect of the invention, a gas injection tube includes a first end adapted to connect to a reactive gas source and a second end. A tube base attaches to the second end of the gas injection tube. The gas injection tube includes a passageway and the tube base includes a channel. The passageway communicates with the channel to provide gas to a molten metal stream traveling through the channel.

The gas injection tube can be used with a variety of molten metal pumps. In one embodiment, the tube base is situated near the outlet of a conventional molten metal pump base such that the channel of the tube base is aligned with the outlet of the pump base. In another embodiment, the tube base is situated near the outlet of a molten metal pump base that includes a nozzle positioned adjacent the outlet. The channel of the tube base is aligned with the outlet, with the molten metal stream passes through the nozzle prior to entering the channel. In yet another embodiment, the tube base is situated near the outlet of a scrap submergence device, such as types shown in U.S. Pat. No. 6,217,823.

DETAILED DESCRIPTION OF THE INVENTION

While the invention will be described in connection with the preferred embodiments, it is to be understood that it is not intended to limit the invention to those embodiments. On the contrary, it is intended to cover all alternatives, modifications and equivalents as may be included within the spirit and scope of the invention defined by the appended claims.

Figure 1:
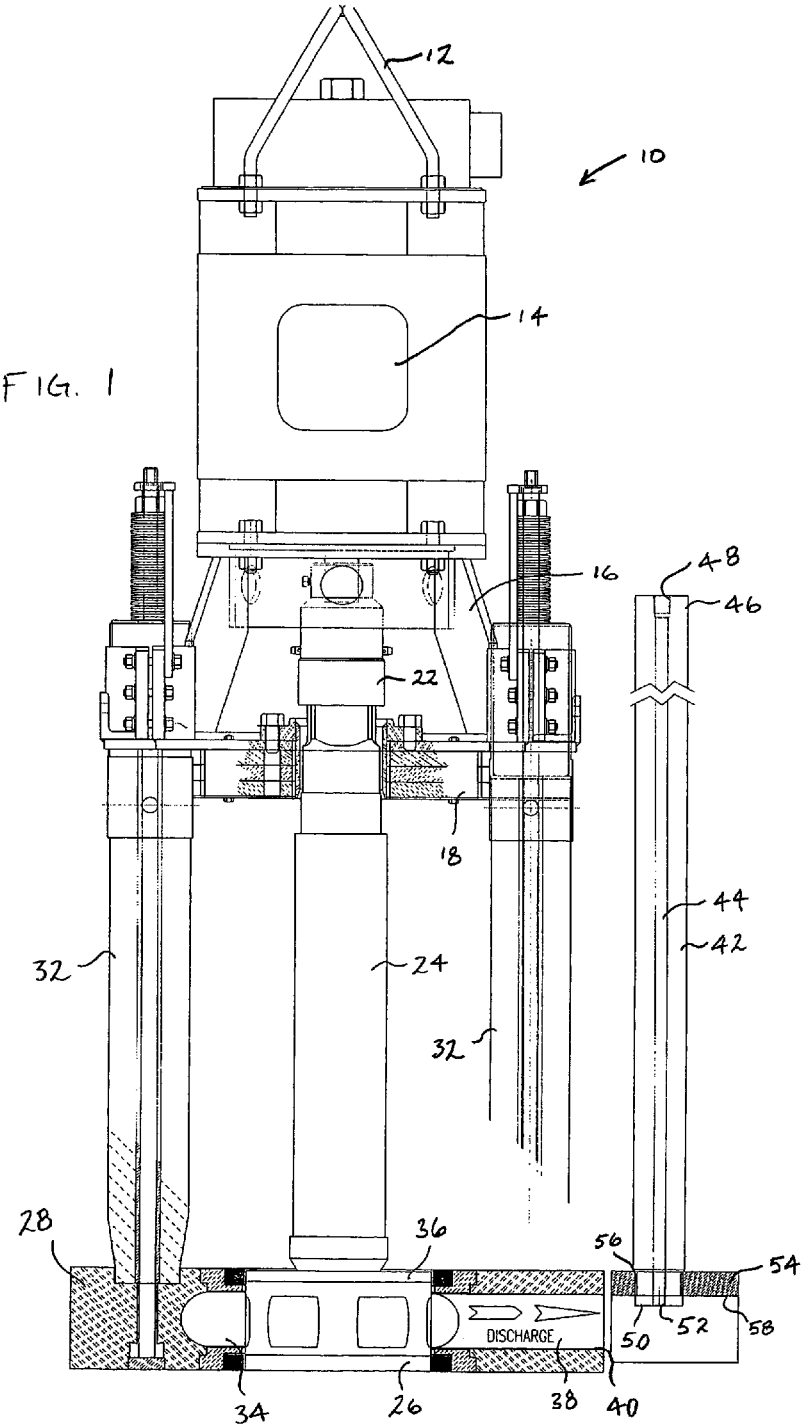
FIG. 1 is a side elevation view, partially in cross section, of a molten metal pump and a gas injection device according to the present invention.

Referring to FIG. 1, a conventional molten metal pump 10 includes a hanger assembly 12 used for lifting and positioning of the pump as necessary within a furnace (not shown). A motor 14 is supported by a motor mount 16, itself supported by a support plate 18. The motor 14 is connected via a coupling assembly 22 to a rotatable shaft 24 secured to an impeller 26.

A pump base 28 rests on the floor of a refractory furnace and forms a foundation for the support plate 18 and motor mount 16 by a plurality of posts 32. The impeller 26 is rotatable within a pumping chamber 34 and its rotation draws molten metal (not shown) into the pumping chamber 34 through an inlet 36 and discharges the molten metal through an outlet passage 38 toward an outlet 40.

A gas injection tube 42 can be positioned in the furnace near the molten metal pump 10. The gas injection tube can be made of a refractory material, such as a ceramic material that would not quickly corrode in a molten metal environment. The tube 42 is hollow and includes a passageway 44. A first end 46 of the tube includes an opening 48 that communicates with the passageway 44. The first end 46 of the tube is adapted to attach to a reactive gas source (not shown). A second end 50 of the tube also includes an opening 52 that communicates with the passageway 44. The second end 50 of the tube attaches to a tube base 54 and protrudes through an opening 56 in the tube base.

Figure 2:
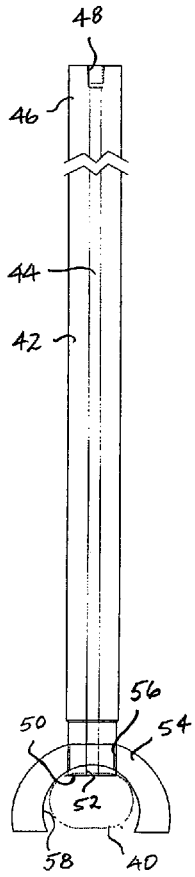
FIG. 2 is an end elevation view of the gas injection device of FIG. 1.

The tube base can also be made of a refractory material. The tube base 54 is situated near the outlet 40 of the pump base 28, obviating the need to provide an extra hole in the pump base. As seen in FIGS. 1 and 2, the tube base 54 can have a substantially elongated horseshoe shape. The tube base 54 defines a channel 58 through which the molten metal that is leaving the outlet 40 (shown in phantom) must pass. The opening 52 of the gas injection tube communicates with the channel 58. Accordingly, the benefits of introducing a reactive gas downstream of a pump chamber can be achieved, however the gas injection tube need not be inserted into a hole in the molten metal pump base.

With further reference to FIG. 2, the shape of the tube base 54 complements the shape of the outlet 40. The second end 50 of the tube 42 can terminate near the upper edge of the outlet 40 and the curve of the channel 58 can follow the contour of the outlet 40. The second end 50 of the tube 42 can also terminate below the upper edge of the outlet 40 so that the gas is injected more towards the bottom of the molten metal stream.

Even though the tube base 54 is shown as a horseshoe configuration having an open bottom, other configurations, including configurations that include a bottom, are contemplated. For example, the base 54 can be rectangular, elliptical and other shapes also. Furthermore, the gas injection tube 42 is shown as being vertical, however it can also be situated at an angle other than normal.

Figure 3:
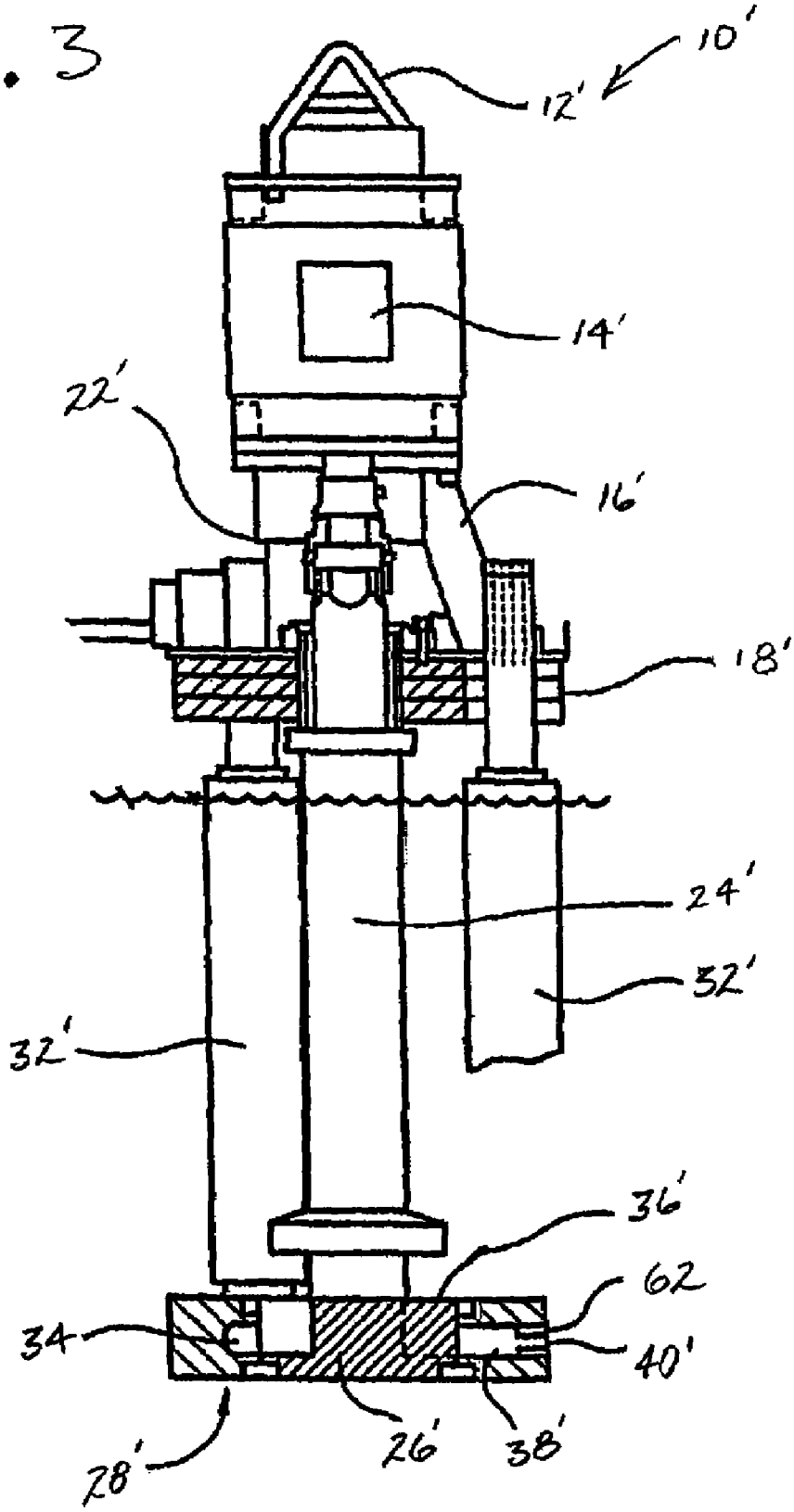
FIG. 3 is a side elevation view, partially in cross section, of a molten metal pump according to an alternative embodiment of the present invention.

FIG. 3 depicts an alternative molten metal pump with which the gas injection tube 42 can be used. In this figure, like numerals having a primed suffix correspond to like components and new numerals correspond to new components. A molten metal pump 10' includes a hanger assembly 12', a motor 14' supported by a motor mount 16', and a support plate 18'. The motor 14' is connected via a coupling assembly 22' to a rotatable shaft 24' secured to an impeller 26'. A pump base 28' rests on the floor of a refractory furnace (not shown) and forms a foundation for the support plate 18' and motor mount 16' by a plurality of posts 32'. The impeller 26' is rotatable within a pumping chamber 34' and its rotation draws molten metal (not shown) into the pumping chamber 34' through an inlet 36' and discharges the molten metal through an outlet passage 38' toward an outlet 40'. Adjacent the outlet 40' is a convergent nozzle 62. The convergent nozzle 62 is more particularly described in U.S. Pat. No. 5,993,728, which is incorporated by reference.

The tube base 54 of the gas injection tube 42 can be placed adjacent the outlet 40' of the outlet passage 38', thus obviating the need to drill a hole in the base 28' into which the gas injection tube can be inserted. Any of the embodiments of the gas injection tube 42 described above can be used with the pump 10'. The tube base 54 of the tube 42 can be positioned adjacent the outlet 40' similar to that shown in FIGS. 1 and 2.

Figure 4:
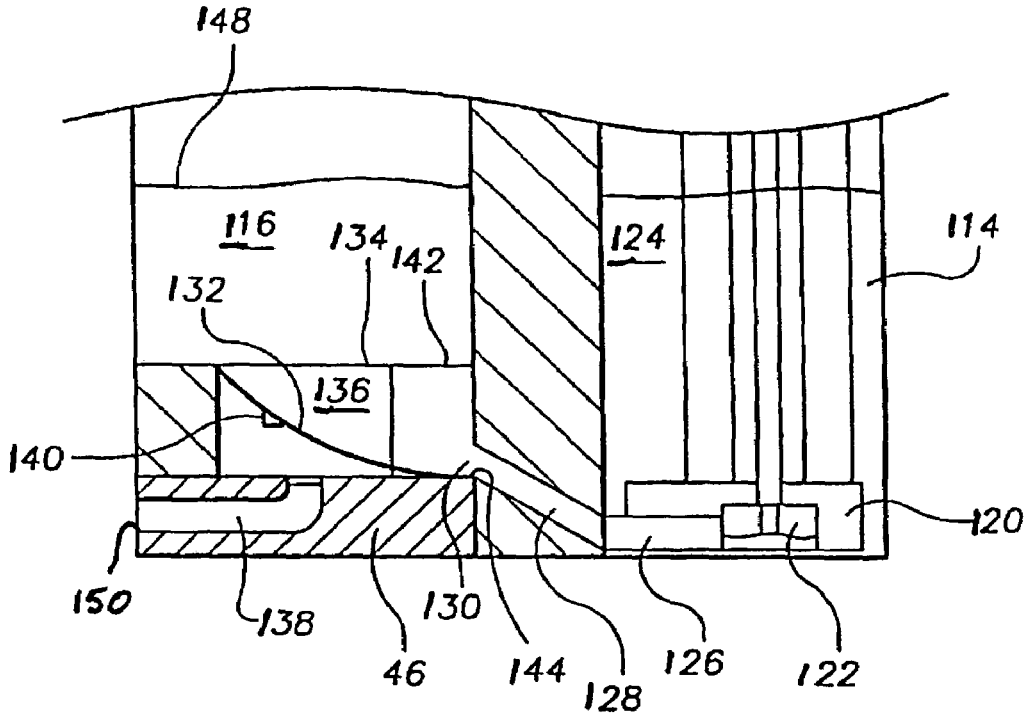
FIG. 4 is a cross-sectional view of a pump well and a charge well of a molten metal scrap submergence device.
Figure 5:
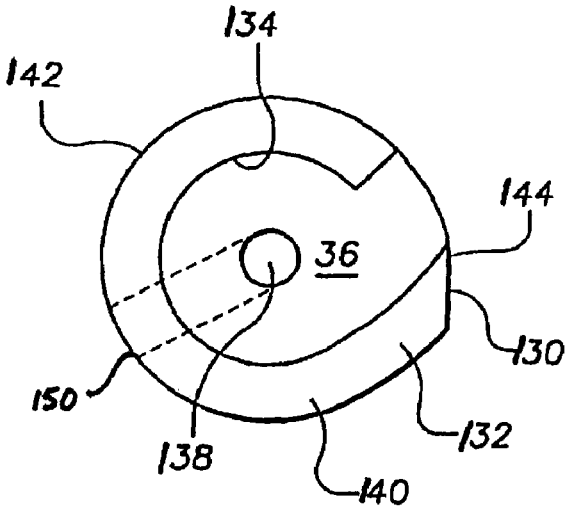
FIG. 5 is a top plan view of the charge well of FIG. 4.

Referring now to FIG. 4, a scrap submergence system is described, similar to U.S. Pat. No. 6,217,823, which is incorporated by reference, and the gas injection tube 42 can be used in this environment also. A pump 120 is positioned in a pump well 114 and draws molten aluminum from a hearth (not shown) forcing it into the charge well 116. Referring also to FIG. 5, rotation of an impeller 122 draws molten aluminum from a bath 124, into the pump 116 and forces it through an outlet 126, up a passage 128, and through an inlet 130 into the charge well 116. Molten aluminum flows up a ramp 132 within the charge well 116, spilling over an inner edge 134 into a cavity 136 and exiting through an opening 138 towards an outlet 150. It is preferred that a leading edge 144 of the ramp 132 be positioned adjacent the inlet 130 to the charge well 116. The ramp 132 can be sloped over a first 180 degree portion 140, and be horizontal over the final about 120 degree portion 142. Metal chips being recycled are deposited onto the surface of the melt 148 in charge well 116. The tube base 54 of the tube 42 can be positioned adjacent the outlet 150 similar to that shown in FIGS. 1 and 2.

The invention has been described in a number of different environments. The gas injection tube and tube base can be used with molten metal pumps and systems described in U.S. Pat. Nos. 5,993,728 and 6,217,823 as well as other conventional molten metal pump systems. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

The invention claimed is:

1. A molten metal pump including a base forming a pumping chamber and an impeller dispersed within said pumping chamber, an outlet in said pump base in fluid communication with said pumping chamber, and further comprising a separable and removable gas injection tube and tube base combination comprising:

said gas injection tube defining a gas passageway and having a first end and a second end, the first end having a gas inlet adapted to communicate with an associated gas source, the second end having a gas outlet; and said tube base defining a molten metal stream passage and having an opening in an upper section of the base, the second end of the tube being received in the opening and terminating such that the gas outlet communicates with the molten metal stream passage, the base is configured to complement an outlet of the base such that the molten metal stream passage is aligned with the outlet of the base.

2. The combination of claim 1, wherein the tube base comprises a horseshoe shaped member having an open bottom.

3. A method for purifying molten metal, the method comprising:

moving molten metal through an outlet of a charge well for a scrap submergence system;

positioning a separate and removable gas injection base including a molten metal passageway adjacent the outlet such that the molten metal passageway is aligned with the outlet; and introducing gas into the molten metal passageway through an opening in the gas injection base.

4. The method according to claim 3 wherein the gas injection base is horseshoe shaped having an open bottom.

* * * * *